US009863255B2

(12) United States Patent
Mugglestone

(10) Patent No.: US 9,863,255 B2
(45) Date of Patent: Jan. 9, 2018

(54) IMPINGEMENT COOLING OF TURBINE BLADES OR VANES

(71) Applicant: Siemens Aktiengesellschaft, Munich (DE)

(72) Inventor: Jonathan Mugglestone, Brinsley (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 619 days.

(21) Appl. No.: 14/373,873

(22) PCT Filed: Nov. 22, 2012

(86) PCT No.: PCT/EP2012/073353
§ 371 (c)(1),
(2) Date: Jul. 22, 2014

(87) PCT Pub. No.: WO2013/120552
PCT Pub. Date: Aug. 22, 2013

(65) Prior Publication Data

US 2015/0016973 A1 Jan. 15, 2015

(30) Foreign Application Priority Data

Feb. 15, 2012 (EP) ..... 12155540

(51) Int. Cl.
*F01D 5/18* (2006.01)
*F01D 9/06* (2006.01)
*F01D 9/02* (2006.01)

(52) U.S. Cl.
CPC ..... *F01D 5/187* (2013.01); *F01D 5/189* (2013.01); *F01D 9/02* (2013.01); *F05D 2260/201* (2013.01)

(58) Field of Classification Search
CPC ..... F05D 2260/201
(Continued)

(56) References Cited

U.S. PATENT DOCUMENTS 3,930,748 A * 1/1976 Redman ..... F01D 5/189 415/115
4,252,501 A * 2/1981 Peill ..... F01D 5/189 415/115

(Continued)

FOREIGN PATENT DOCUMENTS

CN 9412766 A1 6/1994
CN 101769170 A 7/2010

(Continued)

OTHER PUBLICATIONS

RU Office Action dated Jul. 7, 2016, for RU application No. 2014133556.

(Continued)

*Primary Examiner* — Sean J Younger
(74) *Attorney, Agent, or Firm* — Beusse Wolter Sanks & Maire

(57) ABSTRACT

A turbine assembly having a hollow aerofoil and impingement device, the aerofoil having a first side wall from leading to trailing edge and a cavity arranged a distance to an inner surface of the cavity for impingement cooling and a flow channel for cooling medium from the leading to trailing edge, the impingement device has first and second pieces arranged side by side, the second piece downstream of the first forming a first flow passage providing passage from one side of the aerofoil towards an opposite side. A blocking element is arranged in the flow channel between the second piece and first side wall at a suction side for blocking flow of cooling medium from leading to trailing edge denying access to a section of the flow channel downstream of the blocking element while directing cooling medium in the first flow passage away from the suction side towards pressure side.

14 Claims, 7 Drawing Sheets

(58) Field of Classification Search
USPC ..... 415/115
See application file for complete search history.

(56) References Cited

U.S. PATENT DOCUMENTS

| | | | | |
|---|---|---|---|---|
| 4,437,810 | A * | 3/1984 | Pearce | F01D 5/189 415/115 |
| 5,120,192 | A * | 6/1992 | Ohtomo | F01D 5/189 415/115 |
| 5,259,730 | A | 11/1993 | Damlis | |
| 5,533,864 | A | 7/1996 | Ito | |
| 6,416,275 | B1 * | 7/2002 | Itzel | F01D 5/189 415/116 |
| 6,742,991 | B2 * | 6/2004 | Soechting | F01D 5/186 416/96 A |
| 2010/0166564 | A1 | 7/2010 | Benjamin et al. | |
| 2010/0221123 | A1 | 9/2010 | Pal et al. | |

FOREIGN PATENT DOCUMENTS

| | | | |
|---|---|---|---|
| CN | 101825002 | A | 9/2010 |
| CN | 201991570 | U | 9/2011 |
| EP | 1188902 | A1 | 3/2002 |
| EP | 1380724 | A2 | 1/2004 |
| EP | 2224097 | A2 | 9/2010 |
| EP | 2479382 | A1 | 7/2012 |
| EP | 2573325 | A1 | 3/2013 |
| JP | H04-63901 | A | 2/1992 |
| WO | 9412766 | A1 | 6/1994 |
| WO | 2008133758 | A2 | 11/2008 |

OTHER PUBLICATIONS

RU Decision to Grant dated Jan. 10, 2017, for RU patent application No. 2014133556.
EP Search Report dated Nov. 14, 2017, for EP patent application No. 12810113.6.

* cited by examiner

IMPINGEMENT COOLING OF TURBINE BLADES OR VANES

CROSS REFERENCE TO RELATED APPLICATIONS

This application is the US National Stage of International Application No. PCT/EP2012/073353 filed 22 Nov. 2012, and claims the benefit thereof. The International Application claims the benefit of European Application No. EP12155540 filed 15 Feb. 2012. All of the applications are incorporated by reference herein in their entirety.

FIELD OF THE INVENTION

The present invention relates to an aerofoil-shaped turbine assembly such as turbine rotor blades and stator vanes, and to impingement tubes used in such components for cooling purposes.

BACKGROUND TO THE INVENTION

Modern turbines often operate at extremely high temperatures. The effect of temperature on the turbine blades and/or stator vanes can be detrimental to the efficient operation of the turbine and can, in extreme circumstances, lead to distortion and possible failure of the blade or vane. In order to overcome this risk, high temperature turbines may include hollow blades or vanes incorporating so-called impingement tubes for cooling purposes.

These so-called impingement tubes are hollow tubes that run radially within the blades or vanes. Air is forced into and along these tubes and emerges through suitable apertures into a void between the tubes and interior surfaces of the hollow blades or vanes. This creates an internal air flow for cooling the blade or vane.

Normally, blades and vanes are made by a casting having hollow structures in which impingement tubes are inserted for impingement cooling of an impingement cooling zone of the hollow structure. Problems arise when a cooling concept is used by which an impingement cooling in downstream regions of the impingement cooling zone is inefficient due to strong cross flow effects.

This is known from a cooling concept, where a large impingement cooling zone is cooled by a single impingement tube or array and cooling medium discharged from the impingement tube flows from a leading edge to a trailing edge of the aerofoil along a flow channel arranged between an aerofoil wall and the impingement tube.

SUMMARY OF THE INVENTION

It is a first objective of the present invention to provide an advantageous aerofoil-shaped turbine assembly such as a turbine rotor blade and a stator vane. A further objective of the invention is to provide an advantageous impingement tube used in such an assembly for cooling purposes.

Accordingly, the present invention provides a turbine assembly comprising a basically hollow aerofoil and at least an impingement device, wherein the hollow aerofoil has at least a first side wall extending from a leading edge towards a trailing edge of the hollow aerofoil and at least a cavity in which in an assembled state of the at least one impingement device in the hollow aerofoil the at least one impingement device is arranged with a predetermined distance in respect to an inner surface of the cavity for impingement cooling of the at least one inner surface and to form a flow channel for a cooling medium extending from the leading edge towards the trailing edge and wherein the at least one impingement device comprises a first piece and a second piece being arranged side by side in an axial direction with the second piece being located viewed in the axial direction downstream of the first piece and with an axial distance in respect to each other forming a first flow passage providing a passage from one side of the aerofoil towards an opposite side of the aerofoil.

It is provided that the turbine assembly comprises at least a first blocking element, which is arranged in the flow channel between the second piece of the at least one impingement device and the at least first side wall of the hollow aerofoil with the at least first side wall being at a suction side of the hollow aerofoil for blocking the flow of cooling medium in direction from the leading edge to the trailing edge of the hollow aerofoil denying its access to a section of the flow channel downstream of the first blocking element while directing the cooling medium in the first flow passage away from the suction side towards a pressure side of the hollow airfoil.

Due to the inventive matter a cooling effectiveness of the impingement cooling in a region downstream of the at least first blocking element can be maximised. This allows a significant improvement in aerofoil cooling efficiency while minimising performance losses. Specifically, in comparison to state of the art systems lower cooling temperatures and reduced cooling flows can be achieved. Additionally, this provides a high engine performance gain.

Due to this increased impingement cooling effectiveness within the impingement region, less cooling flow will be required compared to state of the art systems.

Moreover, also the cooling efficiency of a pedestal region in a trailing edge region could be improved.

Further, a use of expensive coatings, like a thermal barrier coating (TBC), or additional film cooling means, for example holes or grooves, may be avoided resulting in a reduction of costs and manufacturing efforts.

With the use of such a turbine assembly conventional state of the art aerofoils could be used. Hence, intricate and costly reconstruction of these aerofoils and changes to a casting process could be omitted. Consequently, an efficient turbine assembly or turbine, respectively, could advantageously be provided.

A turbine assembly is intended to mean an assembly provided for a turbine, like a gas turbine, wherein the assembly possesses at least an aerofoil. Preferably, the turbine assembly has a turbine cascade and/or wheel with circumferential arranged aerofoils and/or an outer and an inner platform arranged at opponent ends of the aerofoil(s).

In this context a "basically hollow aerofoil" means an aerofoil with a casing, wherein the casing encases at least one cavity. A structure, like a rib, rail or partition, which divides different cavities in the aerofoil from one another and for example extends in a span wise direction of the aerofoil, does not hinder the definition of "a basically hollow aerofoil".

Preferably, the aerofoil is hollow.

In particular, the basically hollow aerofoil, referred as aerofoil in the following description, has two cooling regions, an impingement cooling region at a leading edge of the aerofoil and a state of the art pin-fin/pedestal cooling region at the trailing edge. These regions could be separated from one another through a rib.

Advantageously, the hollow aerofoil comprises a single cavity. But the invention could also be realized for a hollow aerofoil comprising two or more cavities each of them accommodating an impingement device according to the invention and/or being a part of the pin-fin/pedestal cooling region.

A side wall is intended to mean a region of the turbine assembly which confines at least a part of a cavity and which extends basically along a centre line of the aerofoil, wherein the centre line is curved and extends from the leading edge to the trailing edge of the aerofoil.

In this context an impingement device is at least one piece or an entity of pieces that is constructed independently from the aerofoil and/or is another piece than the aerofoil and/or is not formed integrally with the aerofoil.

The at least one impingement device is inserted into the cavity of the aerofoil during an assembly process of the turbine assembly, especially as a separate piece from the aerofoil. Thus, the at least one impingement device is arranged inside the cavity in an assembled state of the at least one impingement device in the hollow aerofoil.

An assembled state of the at least one impingement device in the aerofoil represents a state of the turbine assembly when it is intended to work and in particular, a working state of the turbine assembly or the turbine, respectively. Arranged between the at least first side wall and the at least one impingement device in the assembled state is a flow channel, which guides the cooling medium at least along the at least first side wall and the at least one impingement device, respectively, from the leading edge towards the trailing edge.

Moreover, the phrase "is used for impingement cooling" is intended to mean that the at least one impingement device is intended, primed, designed and/or embodied to mediate a cooling via an impingement process. An inner surface of the cavity defines in particular a surface which faces an outer surface of the at least one impingement device. The impingement device could be any structure feasible for a person skilled in the art, for example a plate, a box or, in particular, a tube.

In this context a blocking element is intended to mean an element, like a pin, a rod, hypodermic tube, a roll pin or a plate, or any other device suitable for a person skilled in the art, which basically blocks a flow of cooling medium, particularly, downstream of the at least first blocking element.

The term "basically blocks" is intended to mean that the amount of cooling medium entering a section of the flow channel located downstream of the at least first blocking element is at least reduced about 75%, advantageously reduced about 90% and preferably reduced about 99% compared to the amount of cooling medium that would enter the section of the flow channel in state of the art assemblies without a blocking element.

The term "between" should be understood as "in between" or that the at least first blocking element is an element positioned intermediate in respect to the at least first side wall and the at least one impingement device.

The at least first blocking element can be manufactured out of any material feasible for a person skilled in the art, like a ceramic or a metal and especially a metal with a sufficient resistance against high temperatures, like a Ni-alloy.

Further, in the assembled state the at least first blocking element may be held in place via any mechanism suitable for a person skilled in the art, for example a form fit, like screwing or riveting, a force fit, like screwing or knotting, or an adhesive bond, like gluing, welding or brazing, between the at least first side wall and the at least one impingement device.

Generally, an external heat load remains constantly high along the suction side of the aerofoil. Thus, by arranging the blocking element between the at least one impingement device and the suction side the impingement cooling of the inner surface of the suction side can occur unhindered by a cross flow of cooling medium, which is ejected by impingement holes upstream of the blocking element and which flows from the leading edge towards the trailing edge. This arrangement takes also into account, that the suction side carries the higher heat load in comparison with the pressure side and thus needs a better cooling than the latter.

Further, the at least first blocking element extends partially along a span of the at least one impingement device, thus reducing the entering cross flow of cooling medium into the downstream section of the flow channel.

Preferably, the at least first blocking element extends substantially completely along a span of the at least one impingement device, wherein an access of the cross flow of the cooling medium could be efficiently inhibited. As a result, a powerful cooling of the aerofoil can be provided.

A span of the at least one impingement device is intended to mean an extension of the at least one impingement device in a span wise direction of the aerofoil. A span wise direction of the hollow aerofoil is defined as a direction extending basically perpendicular, preferably perpendicular, to a direction from the leading edge to the trailing edge of the aerofoil, also known as a chord wise direction or more specifically an axial chord wise direction of the hollow aerofoil. In the following text this direction is referred to as the axial direction.

The at least one impingement device extends substantially completely through the span of the hollow aerofoil resulting in an efficient cooling of the aerofoil. But it is also conceivable that the at least one impingement device or a section or part of the at least one impingement device would extend only through a part of the span of the hollow aerofoil.

In a preferred embodiment the at least first blocking element is formed integrally with the at least one impingement device. Due to this, a positioning of the at least first blocking element can occur with the assembly of the at least one impingement device. Hence, the location of the at least first blocking element is stationary and loss-proof in respect to the at least one impingement device.

In this context the wording "formed integrally" is intended to mean, that the at least first blocking element and the at least one impingement device or a piece of the at least one impingement device are moulded out of one piece and/or that the at least first blocking element and the at least one impingement device or a piece of the at least one impingement device could only be separate with loss of function for at least one of the parts.

Alternatively, the at least first blocking element could be formed integrally with the at least first side wall or an inner platform and/or an outer platform of the turbine assembly. The platform could be a region of the casing of the aerofoil or a separate piece attached to the aerofoil.

According to a further advantageous embodiment the turbine assembly comprises at least a further blocking element arranged in the flow channel between the at least one impingement device and an at least further side wall of the hollow aerofoil, especially with the at least further side wall being at a pressure side of the hollow aerofoil.

Thus, the cooling effectiveness of the impingement cooling region can be further increased. The features described in this text for the at least first blocking element could be also applied to the at least further blocking element.

Both blocking elements may be embodied of similar or of different type.

The at least first and the at least further side walls are preferably arranged at opposed sides of the aerofoil, i.e. at the suctions side and the pressure side of the aerofoil.

Hence, a homogeneous cooling for the region located downstream of the at least first and further blocking elements is provided.

Generally, any other arrangement feasible for a person in the art may be possible.

In a preferred embodiment, the at least further blocking element is arranged between the at least one impingement device, i.e. between the second piece of the at least one impingement device, and the pressure side of the hollow aerofoil.

Hence, cooling for an additional aerofoil region being charged with a heavy heat load is provided. Therefore, advantageously, the at least first blocking element is arranged between the at least one impingement device, i.e. between the second piece of the at least one impingement device, and the suction side and the at least further blocking element is arranged between the at least one impingement device, i.e. between the second piece of the at least one impingement device, and the pressure side. Due to this arrangement, the impingement region of the aerofoil is efficiently cooled.

Preferably, the impingement device is being formed from at least two separate sections. Thus, properties e.g. cooling properties of the at least two separate sections may be customised according to a location of the at least two separate sections in the aerofoil and/or in respect to the at least first and/or the at least further blocking element.

A section of the impingement device defines a part of the impingement device which is supplied from an exterior of the impingement device with cooling medium in an independent way in respect to another section of the impingement device.

Preferably, the two sections are formed integrally with each other.

The sections may be arranged in respect to each other in any way suitable for a person skilled in the art, e.g. one after the other in span wise and/or in axial and/or in a circumferential direction of the turbine wheel or cascade.

The impingement device is being formed from at least two separate pieces, i.e. from a first and at least a second piece.

To use a two or more piece impingement device allows characteristics of the pieces, like material, material thickness or any other characteristic suitable for a person skilled in the art, to be customised to the cooling function of the piece.

The at least first and second pieces are arranged in the assembled state in the hollow aerofoil with an axial distance in respect to each other forming the at least first flow passage for the cooling medium.

In other words, the at least first flow passage is arranged axially between the first and the at least second piece.

Hence, the cross flow of cooling medium which is blocked from the at least first and/or the at least further blocking element may flow along the at least first passage and thus circumvent the flow channel arranged downstream of the at least first and/or the at least further blocking element.

Due to the intake of the cross flow by the at least first flow passage it operates as a cross flow reduction channel.

This allows the cooling effectiveness of the impingement cooling region to be maximised in the regions downstream of the cross flow reduction channel.

The cross flow passing through the at least first flow passage may be combined with other cooling flows further downstream to maximise the cooling within the trailing edge regions, typically within the pedestal cooling region.

Preferably, the at least first flow passage originates from the suction side and extends in direction to the pressure side of the aerofoil.

The at least first flow passage comprises radial ends and in an advantageous embodiment at least one radial end of the at least first flow passage is sealed in a hermetically sealed manner by a sealing element. Thus, a leakage of the at least first flow passage into the cavity of the aerofoil is efficiently prevented.

The sealing element can be built from any element feasible for a person skilled in the art, like a plug or a plate.

Moreover, advantageously a sealing surface of the sealing element is oriented basically perpendicular to the span wise direction of the impingement device and/or the aerofoil.

In the scope of an arrangement of the surface of the sealing element as "basically perpendicular" to a span wise direction should also lie a divergence of the surface in respect to the span wise direction of about 45°. Preferably, the surface is arranged perpendicular to the span wise direction.

Preferably, both radial ends are each sealed hermetically by a sealing element. Both such sealing elements may be embodied of similar or of different type.

Furthermore, it could be advantageous when the sealing element is formed integrally with the impingement device. As a result, a positioning of the sealing element can happen with the assembly of the at least one impingement device. Thus, the location of the sealing element is stationary and loss-proof in respect to the at least one impingement device.

The sealing element max be formed integrally with one separate section or part of the impingement device.

Alternatively, the sealing element could be formed integrally with the at least first and/or the at least further side wall or the inner platform or the outer platform of the turbine assembly. The sealing elements at the different radial ends may be formed integrally with the same piece, like the impingement device or a part thereof or a side wall or a platform, or with different pieces.

As stated above the hollow aerofoil comprises a centre line—also called camber line—extending from the leading edge to the trailing edge.

To realise the at least first flow passage with a minimum extension, the at least first flow passage is arranged basically perpendicular to the centre line of the hollow aerofoil. In the scope of an arrangement of the at least first flow passage as "basically perpendicular" to a centre line should also lie a divergence of the passage in respect to the centre line of about 45°. Preferably, the passage is arranged perpendicular to the centre line.

In a preferred embodiment the first piece of the impingement device is located towards the leading edge of the hollow aerofoil or more precisely, at the leading edge. This results in an efficient cooling of this region.

Further, the at least second piece of the impingement device can be located viewed in direction from the leading edge to the trailing edge downstream of the first piece or in other words, it is located more towards the trailing edge of the hollow aerofoil than the first piece.

As a result the impingement cooling effectiveness can be further increased throughout the entire impingement region.

Due to this, less cooling flow will be required compared to state of the art systems. In addition to the engine/cycle performance benefits, this reduction in cooling flow within the impingement region has the effect of increasing the cooling effectiveness on the downstream impingement cooling regions due to the reduced cross flow effects in the section of the flow channel downstream of the at least first and/or the at least further blocking element.

In an alternative embodiment the impingement device comprises at least a third piece, wherein in the assembled state in the hollow aerofoil the second piece and the third piece are arranged with a distance in respect to each other forming an at least further flow passage for the cooling medium.

The cross flow that is redirected by the at least first and/or the at least further blocking element can pass through the at least further flow passage toward the trailing edge and thus bypass the section of the flow channel downstream of the at least first and/or the at least further blocking element. Consequently, the over all cooling efficiency can be further maximised and aerodynamic as well as performance losses may be advantageously minimised.

The features described in this text for the at least first flow passage could be also applied to the at least further flow passage.

A homogenous feed to the at least further flow passage can be provided when the at least further flow passage is arranged basically along a centre line of the hollow aerofoil extending from the leading edge to the trailing edge.

In the scope of an arrangement of the at least first flow passage as "basically along" a centre line should also lie a divergence of the passage in respect to the centre line of about 30°. Preferably, the passage is arranged on the centre line. Due to the arrangement of the at least further flow passage on the centre line the second and the at least third pieces are arranged on different sides of the centre line.

Preferably, the first piece is located upstream of the second and the at least third pieces and particularly with an axial distance in respect to the second and the at least third piece so that the at least first flow passage is arranged axially between the first piece and the second and at least third piece.

The second and the at least third pieces may by build similar or different from one another.

Furthermore, the second and the at least third pieces can be arranged in respect to each other in any way suitable for a person skilled in the art, e.g. one after the other in span wise and/or in circumferential direction of the turbine wheel or cascade.

Preferably, the second piece is arranged toward a suction side of the hollow aerofoil and the at least third piece is arranged towards a pressure side of the hollow aerofoil. As a result, both sides of the aerofoil are protected over their whole span wise length from the hindrance of the cross flow from upstream regions.

Advantageously, each of the separate pieces extends substantially completely through the span of the hollow aerofoil resulting in an effective cooling of the aerofoil.

But it is also conceivable that at least one of the at least two or three separate pieces would extend only through a part of the span of the hollow aerofoil. It is also conceivable that the impingement device being formed from more than three separate pieces.

Moreover, the first, the second and the at least third piece are provided with impingement holes. Consequently, a merged stream of cooling medium from these pieces and the first and further passages may pass through the non-impingement pin-fin/pedestal cooling region.

Potentially, the merged stream can exit through the aerofoil trailing edge. Therefore, the trailing edge has exit apertures to allow the merged stream to exit the hollow aerofoil. Due to this, a most effective ejection can be provided. Hence, the aerodynamic/performance losses can be minimised in respect to state of the art systems. In these systems an efficient impingement cooling of the inner surface in the region adjacent to the at least second piece can be hindered by a cross flow from cooling medium discharged from the first piece into the flow channel upstream from the region adjacent to the at least second piece. Consequently, the cooling performance at the pin-fin/pedestal cooling region may also be reduced in state of the art systems.

In a further advantageous embodiment the hollow aerofoil is a turbine blade or vane, for example a nozzle guide vane.

To provide the turbine assembly with good cooling properties and a satisfactory alignment of the impingement device in the aerofoil, the hollow aerofoil comprises at least a spacer at the inner surface of the cavity of the hollow aerofoil to hold the impingement device at the predetermined distance to said surface of the hollow aerofoil.

The spacer is preferably embodied as a protrusion or a locking pin or a rib for easy construction and a straight seat of the impingement device.

The invention further provides an impingement device with a base body for insertion within a cavity of a basically hollow aerofoil of a turbine assembly for impingement cooling of at least an inner surface of the cavity, wherein the base body has at least two tubular sections.

It is provided that the base body comprises at least an aperture, which is arranged between the at least two tubular sections to provide in an assembled state of the base body in the hollow aerofoil at least a first flow channel for a cooling medium.

This allows a significant improvement in aerofoil cooling efficiency while minimising performance losses. Further, the impingement device could be used with state of the art aerofoils to increase their cooling efficiency. Hence, developmental and constructive efforts as well as costs could be reduced, especially, since impingement devices like tubes are low cost items.

In this context a "base body" is intended to mean a structure that substantially imparts a shape and/or form of the impingement device. The at least two tubular sections of the base body are formed integrally with each other.

Preferably, the aperture is arranged axially between the at least two tubular section, thus providing in the assembled state the at least first flow passage to extend between the suction side and the pressure side of the aerofoil.

According to an alternative embodiment the base body has at least a third tubular section and an at least further aperture, wherein the further aperture is arranged between the second section and the at least third section to provide in an assembled state of the base body in the hollow aerofoil at least a further flow channel for the cooling medium.

Thus, in the assembled state of the impingement device in the aerofoil an alternative passage for cooling medium flowing from the leading edge to the trailing edge to the flow channel along the side walls or the suction and/or pressure side can be provided. Consequently, the impingement cooling of the suction and/or pressure side can be embellished unhindered.

In a further embodiment the base body comprises at least a sealing element for sealing at least a radial end of the at least first flow channel and/or the at least further flow channel in a hermetically sealed manner in the assembled state of the base body in the hollow aerofoil.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The present invention will be described with reference to drawings in which.

DETAILED DESCRIPTION OF THE ILLUSTRATED EMBODIMENTS

In the present description, reference will only be made to a vane, for the sake of simplicity, but it is to be understood that the invention is applicable to both blades and vanes of a turbine.

Figure 1:
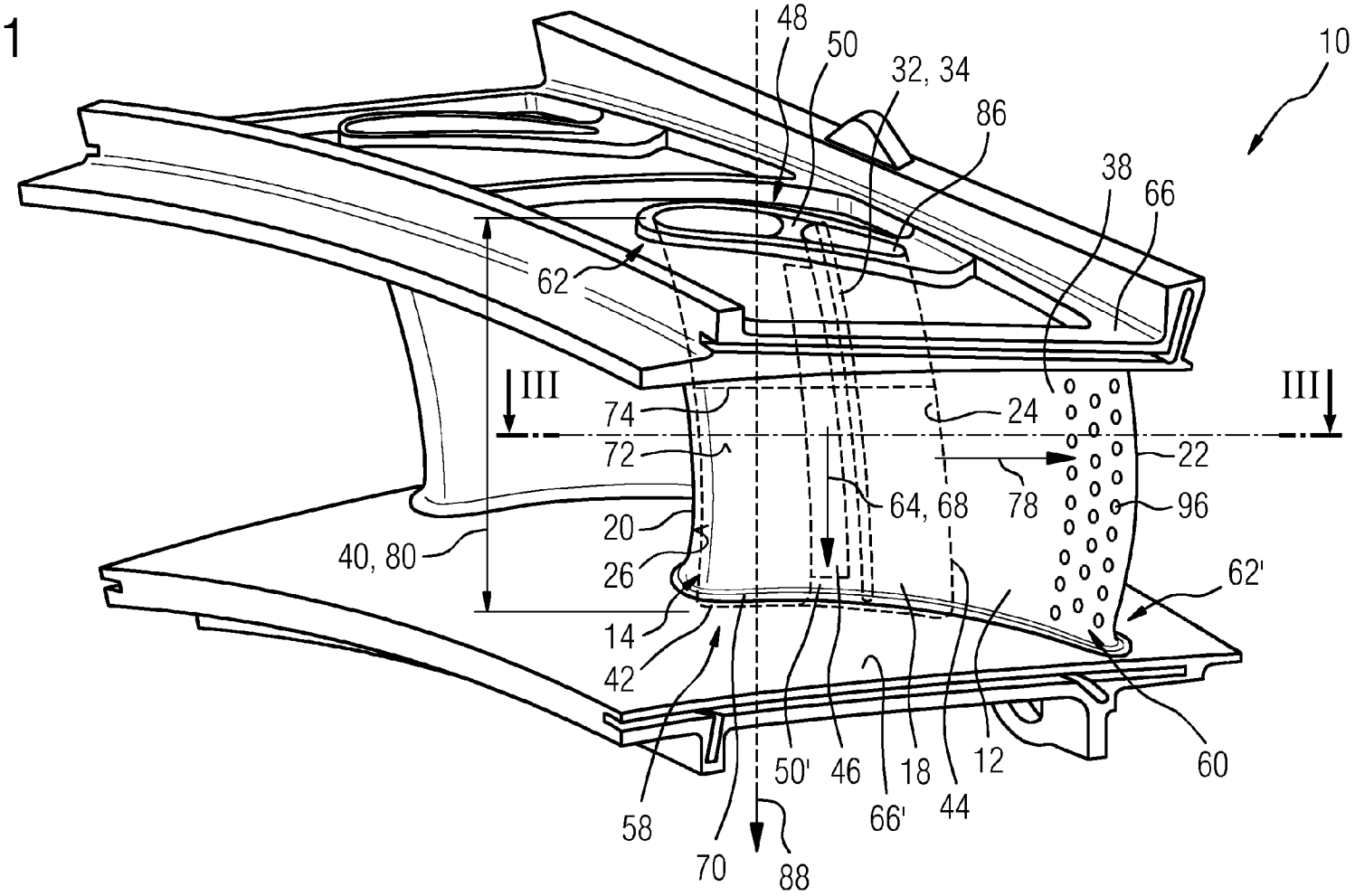
FIG. 1: shows a perspective view of a turbine assembly with an impingement device inserted into an aerofoil.

FIG. 1 shows in a perspective view a turbine assembly 10, in this case a double vane segment. The turbine assembly 10 comprises a basically hollow aerofoil 12, which is referred to as aerofoil 12 in the following text and is embodied as a vane, with two cooling regions, specifically, an impingement cooling region 58 and a trailing edge cooling system 60 (i.e. a pin-fin/pedestal cooling region). The former is located towards a leading edge 20 and the latter towards a trailing edge 22 of the aerofoil 12. At two radial ends 62, 62' of the aerofoil 12, which are arranged in a radial direction 64 opposed towards each other at the aerofoil 12, two platforms, referred to in the following text as an outer platform 66 and an inner platform 66', are arranged. The outer platform 66 and the inner platform 66' are oriented basically perpendicular to a span wise direction 68 of the hollow aerofoil 12. In a circumferential direction of a not shown turbine cascade several aerofoils 12 could be arranged, wherein all aerofoils 12 where connected through the outer and the inner platforms 66, 66' with one another. Individually or multiple aerofoils 12 may be connected to single platforms 66, 66'.

A casing 70 of the hollow aerofoil 12 has two side walls 16, 18, referred to as first side wall 16 and further side wall 18, which each extends from the leading edge 20 towards the trailing edge 22 and which are arranged at opposed sides of the aerofoil 12. The first side wall 16 is a suction side 36 and the further side wall 18 a pressure side 38 of the aerofoil 12. The first and the further side walls 16, 18 enclose a cavity 24 in the impingement cooling region 58. Arranged inside the cavity 24 is an impingement device 14 which is inserted into the cavity 24 during assembly of the turbine assembly 10. Thus, the impingement device 14 is arranged inside the cavity 24 in an assembled or working state of the turbine assembly 10 and specifically with a predetermined distance in respect to an inner surface 26 of the cavity 24.

The impingement device 14, embodied as an impingement tube, is used for impingement cooling of the inner surface 26 of the cavity 24, wherein the inner surface 26 faces an outer surface 72 of the impingement device 14. Moreover, the inner surface 26 comprises a number of spacers 74 to hold the impingement device 14 at a predetermined distance to this surface 26. The spacers 74 are embodied as protrusions or ribs, which extend perpendicular to the span wise direction 68 (see FIG. 3, spacers are shown in a top view). Due to the arrangement of the impingement device 14 with the distance to the inner surface 26 it forms a flow channel 28 for a cooling medium 30, for example air. The cooling channel 28 extends from the leading edge 20 towards the trailing edge 22.

Figure 2:
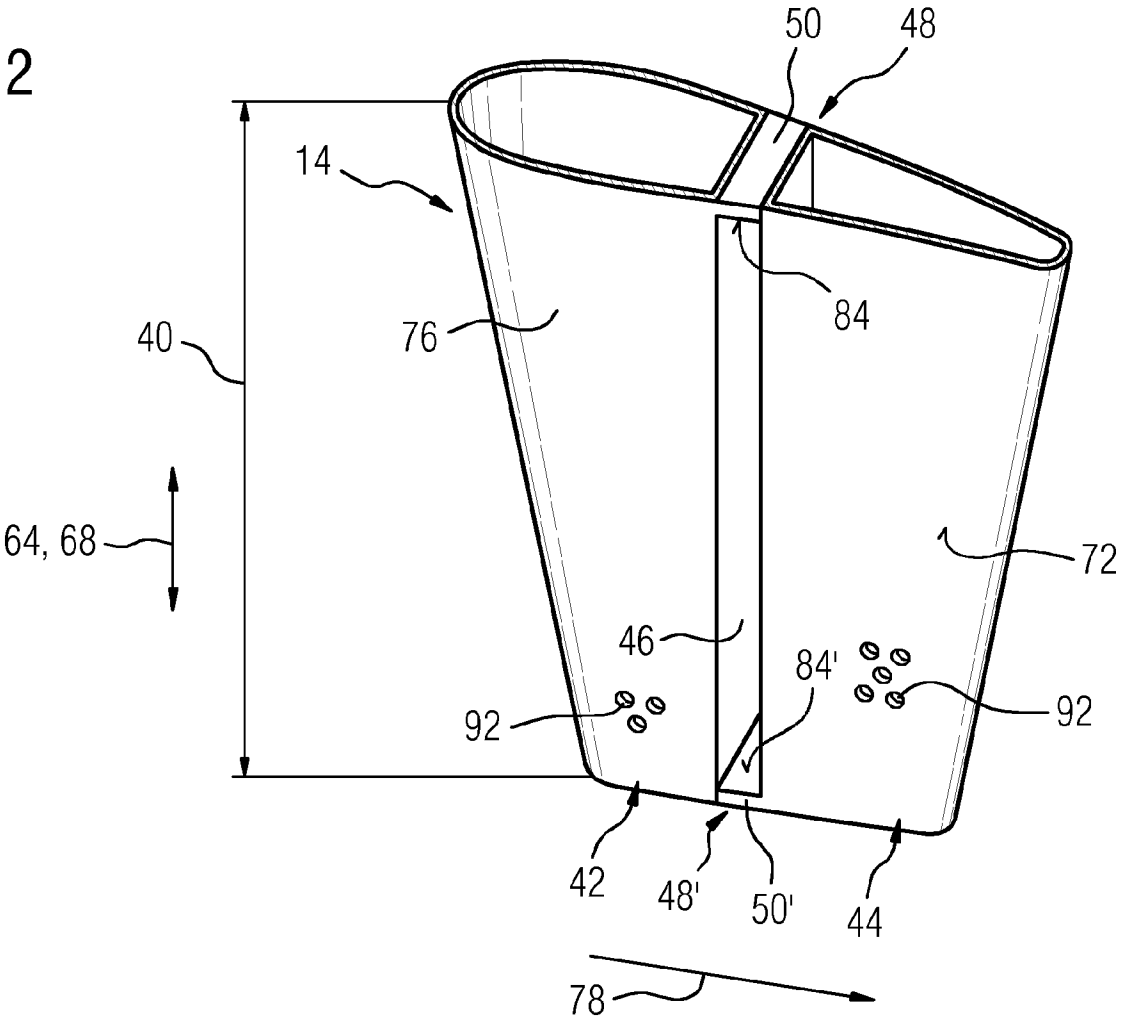
FIG. 2: shows a perspective view of the impingement device from FIG. 1, FIG. 3: shows a cross section through the aerofoil of the turbine assembly with the inserted impingement device along line III-III in FIG. 1, FIG. 4: shows a cross section through an aerofoil of an alternative turbine assembly with an alternatively embodied impingement device

FIG. 2 shows the impingement device 14 with a base body 76 for insertion within the cavity 24. The impingement device 14 has a first tubular section and a second tubular section; wherein the first and the second sections are built from separate pieces 42, 44, so that the impingement device 14 is formed from two separate pieces 42, 44, namely a first piece 42 and a second piece 44, which are both embodied as tubes.

Alternatively, the impingement device could be a single piece construction with two tubular sections. The first piece 42 and the second piece 44 are arranged side by side in an axial direction 78 of the base body 76 or in the assembled state inside the aerofoil 12 in axial direction 78 or chord wise direction, respectively, of the aerofoil 12, respectively. Furthermore, first and second pieces 42, 44 are arranged with an axial distance in respect to each other forming a first flow passage 46 for the cooling medium 30.

In the assembled state of the impingement device 14 in the aerofoil 12 the first piece 42 is located towards or more precisely at the leading edge 20 and the second piece 44 is located viewed in axial direction 78 downstream of the first piece 42 or more towards the trailing edge 22 than the first piece 42. Further, the impingement device 14 or the first and the second pieces 42, 44, respectively, extend in span wise direction 68 completely through a span 80 of the aerofoil 12 (see FIG. 1). The first flow passage 46 is arranged basically perpendicular to a centre line 52 of the aerofoil 12, wherein the centre line 52 is curved and extends from the leading edge 20 to the trailing edge 22. The first flow passage 46 provided a passage for a cooling fluid from one side of the aerofoil 12 to an opposite side of the aerofoil 12.

Figure 3:
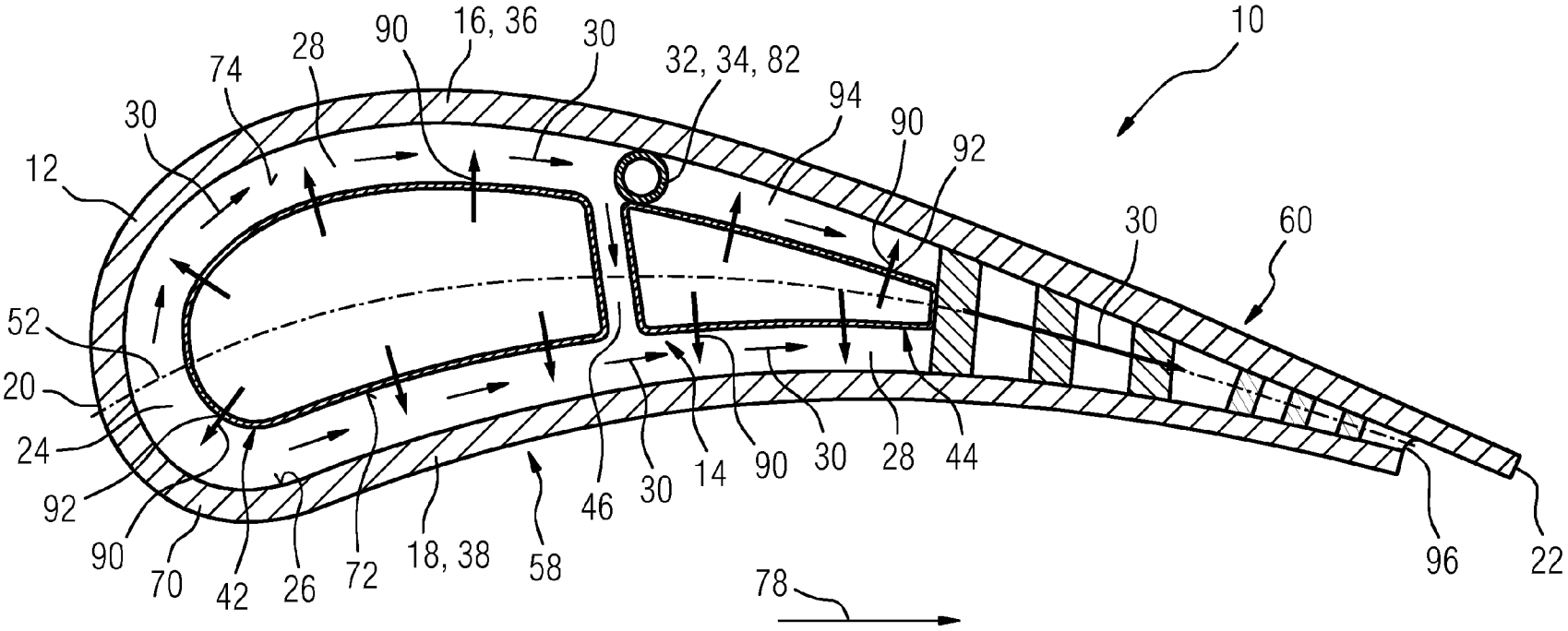

As could be seen in FIG. 3, which shown a cross section through the aerofoil 12 with the inserted impingement device 14, the turbine assembly 10 comprises a first blocking element 32, which is arranged in the flow channel 28 between the impingement device 14, or its outer surface 72, respectively, and the first side wall 16 or the suction side 36, respectively, of the aerofoil 12 for blocking the flow of cooling medium 30 in direction from the leading edge 20 to the trailing edge 22. Viewed in axial direction 78 the first blocking element 32 is located at a side of the second piece 42 that is arranged towards the leading edge 20. Moreover, the first blocking element 32 extends completely along a span 40 of the impingement device 14 and thus completely through the span 80 of the aerofoil 12 (see FIG. 1). Further, the first blocking element 32 is embodied as a hollow tube or cylinder 82 out of for example a Ni-alloy and is inserted during assembly of the turbine assembly 10 with the impingement device 14. In the assembled state the blocking element 32 is held into place via a force fit between the first side wall 16 and the impingement device 14. Alternatively, the blocking element could also be a cast feature/detail of the aerofoil or the platform.

The first flow passage 46 comprises radial ends 48, 48' which are both sealed in a hermetically sealed manner by a sealing element 50, 50' to prevent a radial leakage of cooling medium 30 from the first flow passage 46 into the cooling channel 28 or the exterior of the aerofoil 12, respectively (see FIG. 1). The sealing elements 50, 50' are formed integrally with the impingement device 14 or more precisely each sealing element 50, 50' is formed integrally with one of the pieces 42, 44 (see FIG. 2). Furthermore, the sealing elements 50, 50' are embodied as plates whose sealing surfaces 84, 84' are oriented perpendicular to the span wise direction 68. Alternatively, the sealing elements may be built from separate pieces in respect to the impingement device 14.

During an operation of the turbine assembly 10 cooling medium 30 enters the aerofoil 12 or the impingement device 14 through apertures 86 in the inner and outer platforms 66, 66', wherein these apertures 86 are arranged in alignment with the impingement cooling region 58 of the aerofoil 12. The impingement device 14 or its pieces 42 and 44, respectively, provide a flow path 88 for the cooling medium 30. The cooling medium 30 is ejected as jets 90 through impingement holes 92 of the impingement device 14 (only partially shown in FIG. 2) into the flow channel 28 to impinge at the inner surface 26 and thus cooling the latter (see FIG. 3). The cooling medium 30 ejected from the first piece 42 flows downstream toward the trailing edge 22. Due to the first blocking element 32 an access to a section 94 of the flow channel 28 downstream of the first blocking element 32 is denied. Hence, a disturbance of jets 90 which eject from the second piece 44 into the section 94 is prevented, hence providing a high cooling effectiveness for the first side wall 16 or the suction side 36, respectively. Moreover, due to the blocking element 32 the cooling medium 30 enters the first flow passage 46 arranged basically axially between the pieces 42 and 44 and flows from the suction side 36 to the pressure side 38. There it merges with the cooling medium 30 ejected towards the pressure side 38 and flows downstream towards the trailing edge cooling region 60 (i.e. pin-fin/pedestal cooling region) at the trailing edge 22 where it exits the aerofoil 12 through exit apertures 96 of the trailing edge 22.

In an alternative not shown embodiment the first section or piece and the second section or piece of the impingement device may be formed integrally with each other or may be moulded out of one piece.

In FIGS. 4 to 7 alternative embodiments of the impingement device 14, the turbine assembly 10 and the blocking elements 32 and 34 are shown. Components, features and functions that remain identical are in principle substantially denoted by the same reference characters. To distinguish between the embodiments, however, the letters "a" to "d" has been added to the different reference characters of the embodiment in FIGS. 4 to 7. The following description is confined substantially to the differences from the embodiment in FIGS. 1 to 3, wherein with regard to components, features and functions that remain identical reference may be made to the description of the embodiment in FIGS. 1 to 3.

Figure 4:
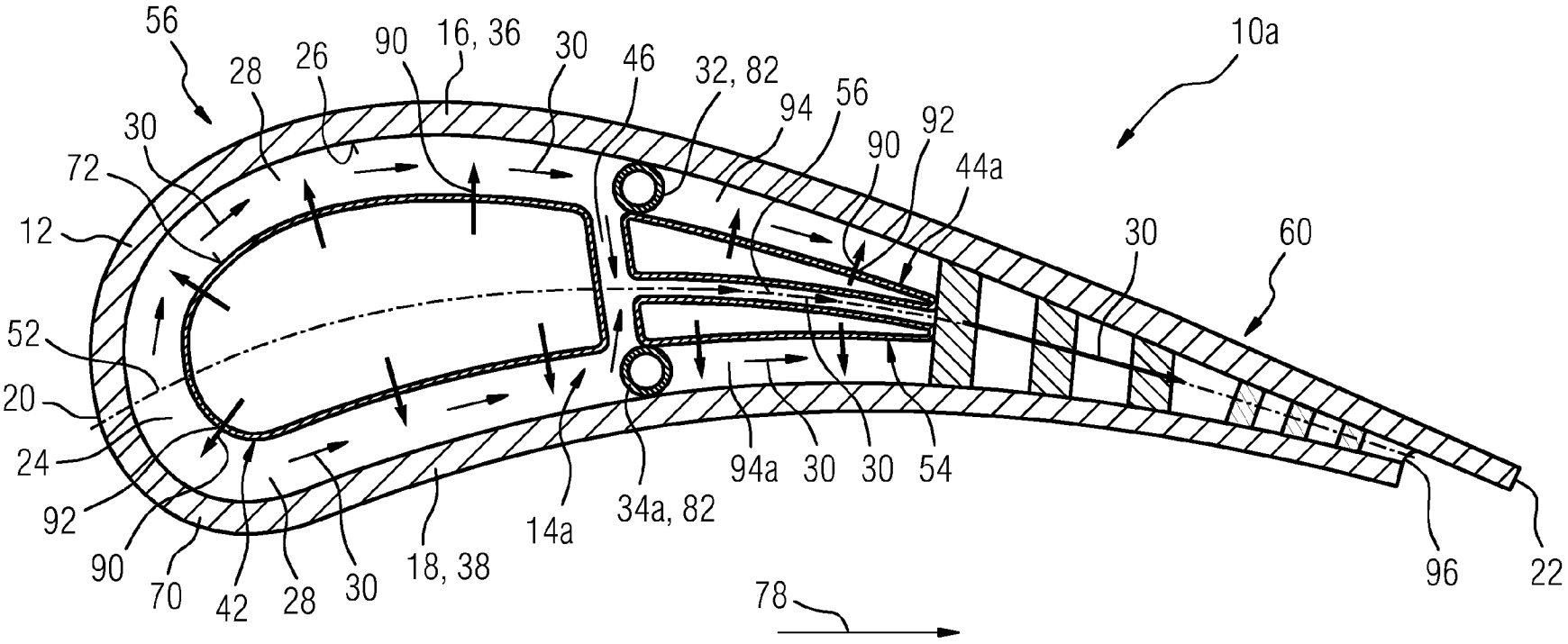

FIG. 4 shows a cross section through a turbine assembly 10*a* analogously formed as in FIGS. 1 to 3 with a further blocking element 34*a* and an alternatively embodied impingement device 14*a*. The embodiment from FIG. 4 differs in regard to the embodiment according to FIGS. 1 to 3 in that a further blocking element 34*a* is provided. It is arranged in a flow channel 28 for cooling medium 30 between an impingement device 14*a* and an further side wall 18 of a hollow aerofoil 12, wherein the further side wall 18 is a pressure side 38 of the aerofoil 12.

Moreover, this embodiment differs in that the impingement device 14*a* comprises, in addition to a first piece 42 and a second piece 44*a*, a third piece 54. In an assembled state of the pieces 42, 44*a*, 54 in the aerofoil 12 the first piece 42 is arranged at the leading edge 20 and the second and third pieces 44*a*, 54 downstream of the first piece 42 towards the trailing edge 22. Thus, the first piece 42 is located upstream of the second and the third piece 44*a*, 54 and with an axial distance in respect to the second and the third piece 44*a*, 54 so that a first flow passage 46 is arranged axially between the first piece 42 and the second and third pieces 44*a*, 54. Furthermore, the second piece 44*a* and the third piece 54 are arranged with a distance in respect to each other to form a further flow passage 56 for the cooling medium 30. This further flow passage 56 is arranged basically along a centre line 52 of the aerofoil 12, the centre line 52 extending from the leading edge 20 to the trailing edge 22. Thus, the second and the third piece 44*a*, 54 are arranged on different sides of the centre line 52. Moreover, the second piece 44*a* is arranged toward the suction side 36 and the third piece 54 is arranged towards the pressure side 38 of the aerofoil 12.

In other words, the further flow passage 56 provides a fluid passage beginning from the first flow passage 46 as an upstream end of the further flow passage 56 in direction of the trailing edge 22 of the aerofoil 12.

Cooling medium 30 ejected from the first piece 42 flows downstream toward the trailing edge 22 during operation of the turbine assembly 10*a* and an access to sections 94, 94*a* of the flow channel 28 downstream of the first and further blocking elements 32, 34*a* is blocked by the latter. Hence, a disturbance of jets 90 which eject from the second piece 44*a* and the third piece 54 into the sections 94, 94*a* is prevented providing a high cooling effectiveness for both side walls 16, 18 or the suction and the pressure side 36, 38, respectively. Furthermore, due to the blocking elements 32, 34*a* the cooling medium 30 enters the first flow passage 46 and flows from the suction side 36 towards the pressure side 38. Halfway along the first flow passage 46 the cooling medium 30 enters the further flow passage 56 and thus flows towards the trailing edge 22 to exit the aerofoil 12.

Figure 5:
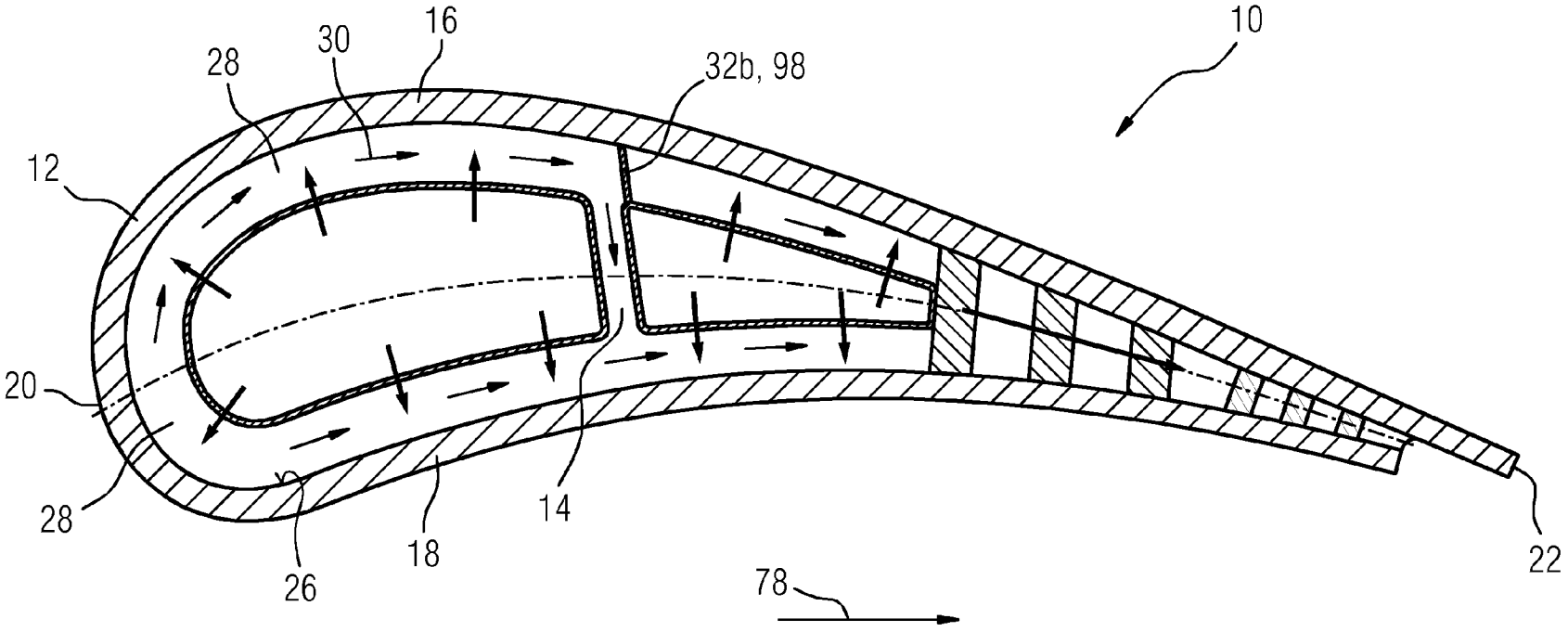
FIG. 5-7: shows each a cross section through an aerofoil with an alternatively embodied blocking element.
Figure 6:
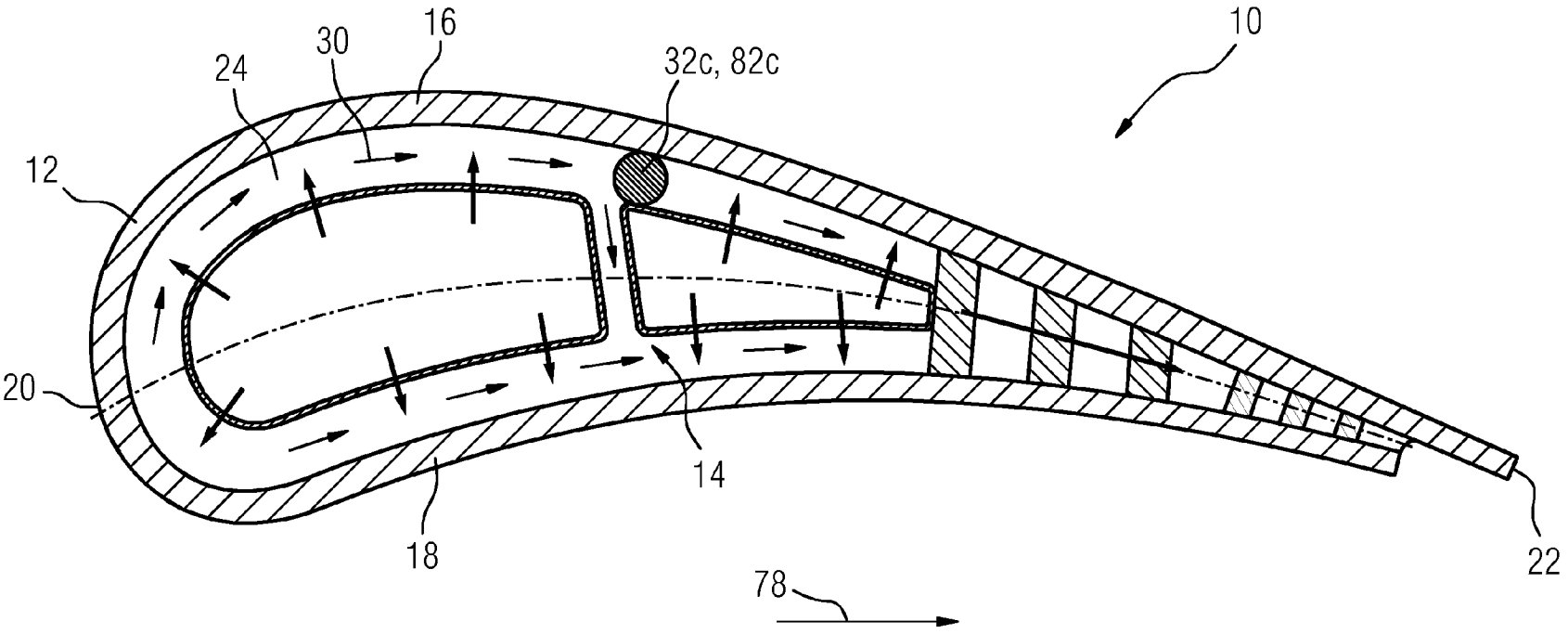
Figure 7:
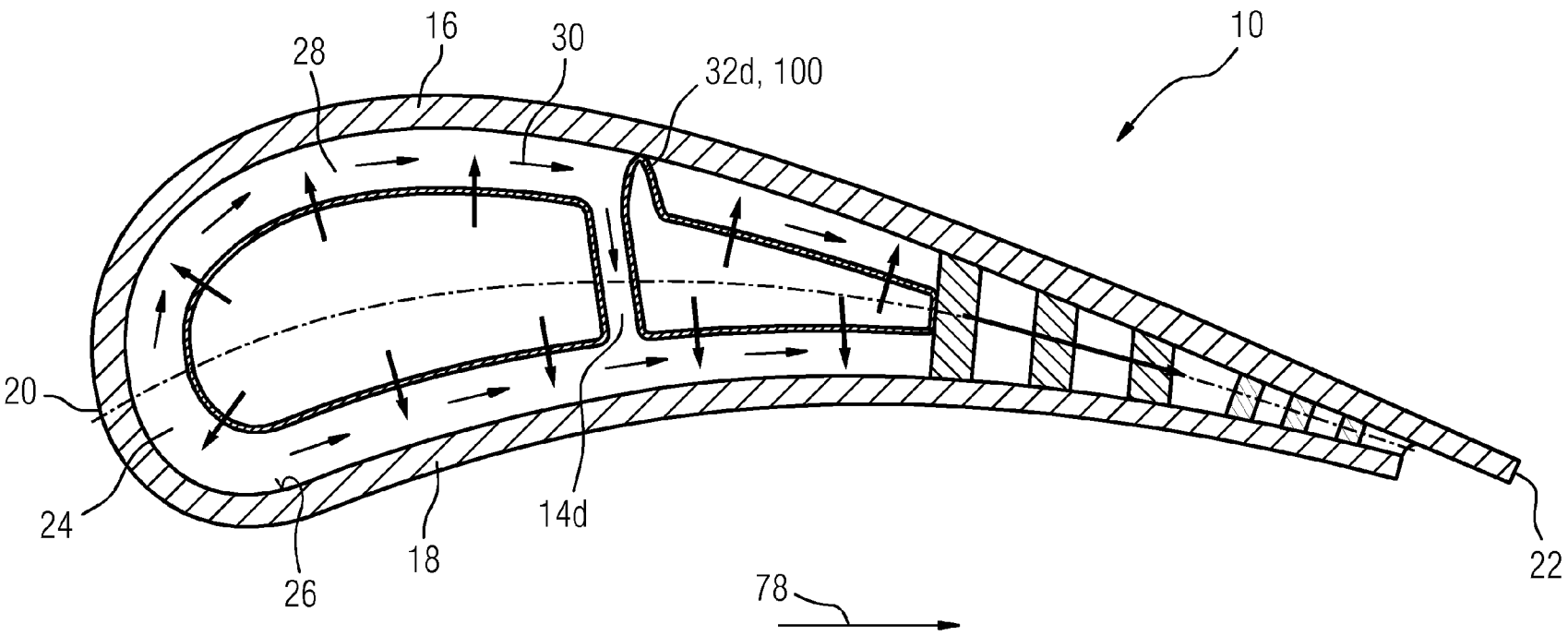

FIGS. 5 to 7 show different embodied blocking elements 32*b*-32*d*. They are only shown for an embodiment analogous to the embodiment of FIGS. 1 to 3. But it is also applicable to the embodiment shown in FIG. 4. Moreover, by an embodiment with two blocking elements also a combination of two designs shown in FIGS. 4 and 5 to 7 is possible.

In FIG. 5 a blocking element 32*b* is shown which is embodied as a wall 98 extending from a side wall 16 to an impingement device 14. FIG. 6 shows a blocking element 32*c* which is embodied as a solid cylinder 82*c*. In FIG. 7 a blocking element 32*d* is depicted that is embodied as a curvature 100 in direction of a side wall 16. Further, the blocking element 32*d* is formed integrally with an impingement device 14*d*. In general, it may be also possible to form the blocking elements 32, 32*b*, 32*c*, 34, 34*a* integrally with the impingement device 14, 14*a*, 14*b*, 14*c*.

Although the invention is illustrated and described in detail by the preferred embodiments, the invention is not limited by the examples disclosed, and other variations can be derived therefrom by a person skilled in the art without departing from the scope of the invention.

The invention claimed is:

1. A turbine assembly comprising:

a basically hollow aerofoil and at least one impingement device, wherein the hollow aerofoil comprises at least one first side wall extending from a leading edge towards a trailing edge of the hollow aerofoil, and at least one cavity in which in an assembled state of the at least one impingement device in the hollow aerofoil the at least one impingement device is arranged: at a predetermined distance from an inner surface of the at least one cavity for impingement cooling of the inner surface; and to form a flow channel for a cooling medium extending from the leading edge towards the trailing edge, and wherein the at least one impingement device comprises a first piece and a second piece arranged side by side in an axial direction from the leading edge to the trailing edge, with the first piece located towards the leading edge and the second piece located towards the trailing edge, and with an axial distance therebetween that forms a first flow passage that provides a passage from one side of the hollow aerofoil towards an opposite side of the hollow aerofoil, and at least one first blocking element arranged in the flow channel between a side of the second piece that is closer to the leading edge than to the trailing edge and the at least one first side wall of the hollow aerofoil, wherein the at least one first side wall comprises a suction side wall of the hollow aerofoil, and wherein the at least one first blocking element is configured to block a flow of cooling medium in a direction from the leading edge to the trailing edge of the hollow aerofoil, thereby denying the flow of cooling medium direct access to a section of the flow channel downstream of the at least one first blocking element while directing the flow of cooling medium into the first flow passage away from the suction side wall towards a pressure side wall of the hollow aerofoil, wherein the flow of cooling medium then flows directly from the first flow passage axially toward the trailing edge between the second piece and the pressure side wall.

2. The turbine assembly according to claim 1, wherein the at least one first blocking element extends at least partially along a span of the at least one impingement device.

3. The turbine assembly according to claim 2, wherein the at least one first blocking element extends substantially completely along the span of the at least one impingement device.

4. The turbine assembly according to claim 1, wherein the at least one first blocking element is formed integrally with the at least one impingement device.

5. The turbine assembly according to claim 1, further comprising at least one further blocking element arranged in the flow channel between the at least one impingement device and at least one further side wall of the hollow aerofoil.

6. The turbine assembly according to claim 5, wherein the at least one further side wall comprises the pressure side wall of the hollow aerofoil, and wherein the at least one further blocking element is arranged between the second piece of the at least one impingement device and the pressure side wall of the hollow aerofoil.

7. The turbine assembly according to claim 1, wherein the first flow passage comprises radial ends and wherein at least one radial end of the first flow passage is sealed in a hermetically sealed manner by a sealing element.

8. The turbine assembly according to claim 7, wherein the sealing element is formed integrally with the at least one impingement device.

9. The turbine assembly according to claim 1, wherein the hollow aerofoil comprises a centre line extending from the leading edge to the trailing edge, wherein the first flow passage is arranged basically perpendicular to the centre line of the hollow aerofoil.

10. The turbine assembly according to claim 1, wherein the at least one impingement device comprises a third piece, wherein in the assembled state in the hollow aerofoil the third piece is disposed between the second piece and the pressure side wall, and the second piece and the third piece are arranged with a distance in respect to each other forming at least one further flow passage therebetween, and wherein the cooling medium flows from the first flow passage axially toward the trailing edge in the at least one further flow passage and then out through the trailing edge.

11. The turbine assembly according to claim 10, wherein the at least one further flow passage is arranged basically along a centre line of the hollow aerofoil extending from the leading edge to the trailing edge.

12. The turbine assembly according to claim 10, wherein the second piece is arranged toward the suction side wall of the hollow aerofoil and the third piece is arranged towards the pressure side wall of the hollow aerofoil.

13. The turbine assembly according to claim 1, wherein the hollow aerofoil is a turbine blade or vane.

14. The turbine assembly according to claim 1, wherein the cooling medium flows from the first flow passage axially toward the trailing edge between the second piece and the pressure side wall and then out through the trailing edge.

* * * * *